US006116992A

United States Patent [19]

Prince

[11] Patent Number: 6,116,992

[45] **Date of Patent: *Sep. 12, 2000**

[54] SUBSTRATE RETAINING RING

[75] Inventor: John Prince, Los Altos, Calif.

[73] Assignee: Applied Materials, Inc., Santa Clara, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 09/000,516

[22] Filed: Dec. 30, 1997

[51] Int. Cl.[7] ..... C23F 1/02; B24B 5/00; B24B 29/00

[52] U.S. Cl. ..... 451/286; 451/285; 451/287; 451/288; 156/345

[58] Field of Search ..... 451/285, 286; 216/88; 156/345

[56] References Cited

U.S. PATENT DOCUMENTS

| | | | |
|---|---|---|---|
| 5,205,082 | 4/1993 | Shendon et al. | 51/283 |
| 5,584,751 | 12/1996 | Kobayashi et al. | 451/288 |
| 5,605,487 | 2/1997 | Hileman et al. | 451/5 |
| 5,664,988 | 9/1997 | Stroupe et al. | 451/41 |
| 5,762,544 | 6/1998 | Zuniga et al. | 451/285 |

OTHER PUBLICATIONS

Ali, et al., Investigating the Effect of Secondary Platen Pressure on Post–Chemical–Mechanical Planarization Cleaning, *Microcontamination*, pp. 45–50, Oct. 1994.

Kolenkow and Nagahara, Chemical–Mechanical Wafer Polishing and Planarization in Batch Systems, *Solid State Technology*, pp. 112–114, Jun. 1992.

Scott R. Runnels, Modeling the Effect of Polish Pad Deformation on Wafer Surface Stress Distributions During Chemical–Mechanical Polishing.

Yuan, et al., A Novel Wafer Carrier Ring Design Minimizes Edge Over–Polishing Effects for Chemical Mechanical Polishing, Jun. 27–29 1995 VMIC Conference, 1995 ISMIC 104/95/525, pp. 525–527.

*Primary Examiner*—Jeffrie R Lund
*Assistant Examiner*—Alva C. Powell
*Attorney, Agent, or Firm*—Fish & Richardson

[57] ABSTRACT

A retaining ring is configured for use with an apparatus for polishing a substrate. The substrate has upper and lower faces and a perimeter. The apparatus has a movable polishing pad with an upper polishing surface for contacting and polishing the lower face of the substrate. The retaining ring has a retaining face for engaging and retaining the substrate against lateral movement and a bottom face for contacting the polishing surface of the polishing pad. The bottom face of the retaining ring extends downward from an inner portion adjacent the retaining face to a lowermost portion radially outboard of the retaining face.

17 Claims, 4 Drawing Sheets

SUBSTRATE RETAINING RING

BACKGROUND

The present invention relates generally to chemical mechanical polishing of substrates, and more particularly to a substrate carrier head and retaining ring of a chemical mechanical polishing system.

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the surface of the substrate on which deposition occurs, i.e., the exposed surface of the substrate, becomes increasingly non-planar. This non-planar surface presents problems in the photolithographic steps of the integrated circuit fabrication process. Therefore, there is a need to periodically planarize the substrate surface.

Chemical mechanical polishing (CMP) is one accepted method of planarization. This planarization method typically requires that the substrate be mounted on a carrier (polishing head). The exposed surface (the lower surface as when the substrate is held in the polishing head) of the substrate is placed against a rotating polishing pad. The polishing pad may be a "standard" pad in which the polishing pad surface is a durable roughened surface, or may be a fixed abrasive pad in which abrasive particles are held in a containment media. The polishing head provides a controllable load, i.e., force, on the substrate which pushes the substrate against the polishing pad. A polishing slurry is supplied to the polishing pad. The slurry includes at least one chemically-reactive agent, and, if a standard pad is used, includes abrasive particles is supplied to the polishing pad.

The effectiveness of a CMP process may be measured by its polishing rate and by the resulting finish (absence of small-scale roughness) and flatness (absence of large-scale topography) of the substrate surface. The polishing rate, finish and flatness are determined by the pad and slurry combination, the relative speed between the substrate and pad, and the force pressing the substrate against the polishing pad.

A reoccurring problem in CMP is the so-called "edge-effect", i.e., the tendency for the edge of the substrate to be polished at a different rate than the center of the substrate. The edge effect typically results in over-polishing (the removal of too much material from the substrate) of the perimeter portion, e.g., the outermost five to ten millimeters, of the substrate. The over-polishing of the substrate perimeter reduces the overall flatness of the substrate, makes the edge of the substrate unsuitable for use in integrated circuits, and decreases the yield.

In view of the foregoing, there is a need for a chemical mechanical polishing apparatus which provides the desired surface flatness and finish while minimizing the edge effect.

SUMMARY

According to one aspect, the invention provides a retaining ring for use with a substrate polishing apparatus. The substrate has upper and lower faces and a perimeter. The polishing apparatus has a movable polishing pad with an upper polishing surface for contacting and polishing the lower face of the substrate. The retaining ring has a retaining face for engaging and retaining the substrate against lateral movement, and has a bottom face for contacting the polishing surface of the polishing pad. The bottom face of the retaining ring descends from an inner portion adjacent the retaining face to a lowermost portion radially outboard of the retaining face.

Implementations of the invention may include one or more of the following. The lowermost portion may be approximately 5–15 millimeters outboard of the retaining face. The lowermost portion may be approximately 10 millimeters outboard of the retaining face. The lowermost portion may be approximately 0.5 to 2.0 millimeters below an intersection of the bottom face and the retaining face. The lowermost portion may be approximately 1 millimeter below an intersection of the bottom face and the retaining face. The bottom face may ascend from the lowermost portion to an outer portion radially outboard of the lowermost portion. An intersection of the retaining face and the inner portion of the bottom face may be at a substantially even level with the lower face of the substrate when the retaining face engages the substrate.

According to another aspect, the invention is directed to a retaining ring for use in conjunction with an apparatus for polishing a substrate. The substrate has upper and lower faces and a lateral perimeter. The apparatus has a polishing pad with an upper polishing surface for contacting and polishing the lower face of the substrate. The retaining ring has an inner face for surrounding and engaging the substrate perimeter. The retaining ring has a bottom face extending outward from the inner face for contacting the polishing surface of the polishing pad. The bottom face of the retaining ring has an annular downward facing convex region.

Implementations of the invention may include one or more of the following. The bottom face of the retaining ring may have an annular downward facing concave region inboard of the annular downward facing convex region. The bottom face of the retaining ring may have a second annular downward facing concave region outboard of the annular downward facing convex region. The bottom face of the retaining ring may have a annular downward facing flat horizontal region inboard of the annular downward facing convex region. The retaining face may be substantially vertical and the ring may further comprise a vertical outboard face. The bottom face of the ring may connect the retaining face and the outboard face, and have a first annular intersection with the retaining face and a second annular intersection with the outboard face. The first annular intersection may be located at a lower height than the second annular intersection.

According to another aspect, the invention has a retaining ring having an inward facing retaining face for engaging and retaining a substrate against lateral movement, and a bottom face for contacting the polishing surface of a polishing pad. The bottom face has a downward projecting lip, which projects below the lower face of the substrate.

According to another aspect, the invention has a polishing head for holding a substrate in engagement with a movable polishing pad. The head has a housing and a substrate backing member for engaging an upper surface of the substrate. The substrate backing member is vertically movable relative to the housing for maintaining a lower surface of the substrate in engagement with an upper surface of the polishing pad. A retaining ring is vertically movable relative to the substrate backing member and has an inward facing retaining face for engaging and retaining the substrate against lateral movement. The retaining ring has a bottom face for contacting the upper surface of the polishing pad. The bottom face descends from an inner portion adjacent the retaining face to a lowermost portion radially outboard of the retaining face. The bottom face of the retaining ring may ascend from the lowermost portion to an outer portion, radially outboard of the lowermost portion.

The details of one or more embodiments of the invention are set forth in the accompanying drawings and the description below. Other features, objects, and advantages of the invention will be apparent from the description and drawings, and from the claims.

DESCRIPTION OF DRAWINGS

The accompanying drawings which are incorporated in and constitute a part of the specification schematically illustrate the invention, and together with the general description given above and the detailed description given below, serve to explain the principles of the invention.

Like reference numbers and designations in the various drawings indicate like elements.

DETAILED DESCRIPTION

Figure 1:
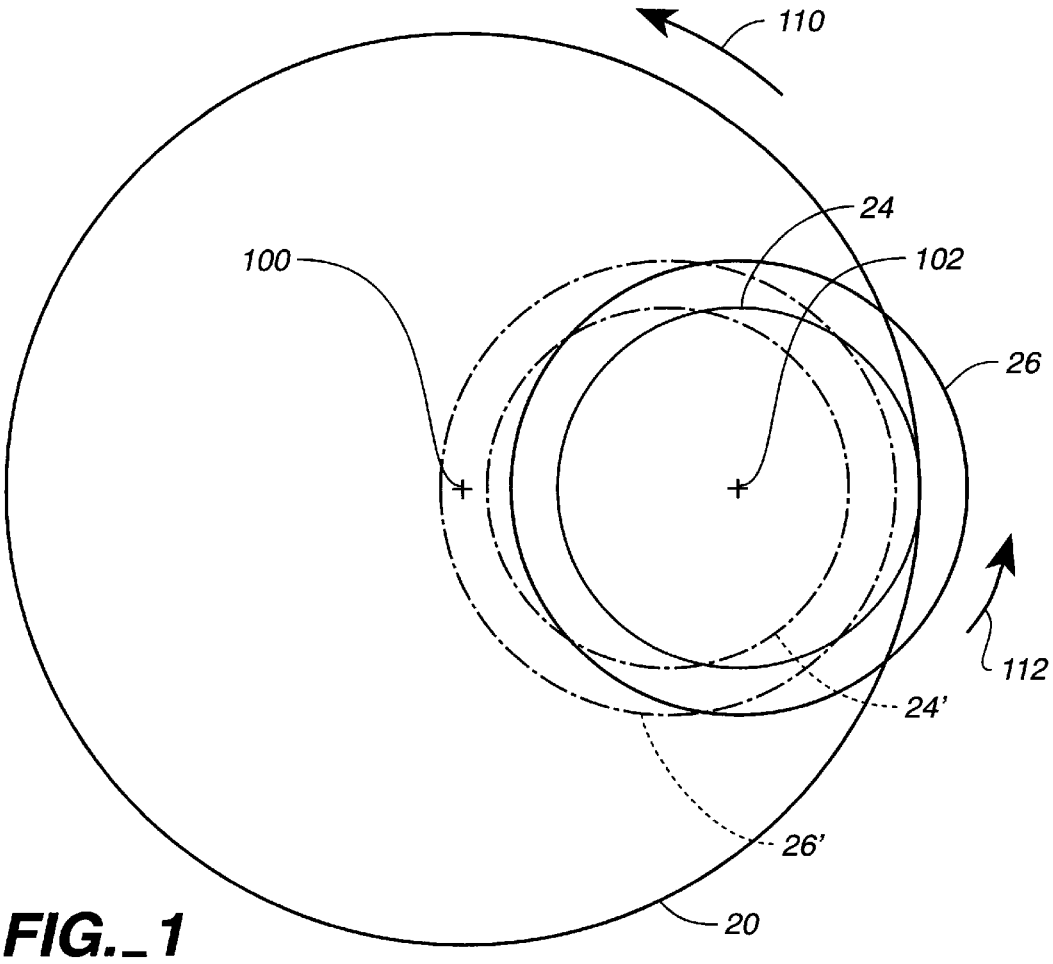
FIG. 1 is a schematic top view of a platen of a CMP system.
Figure 2:
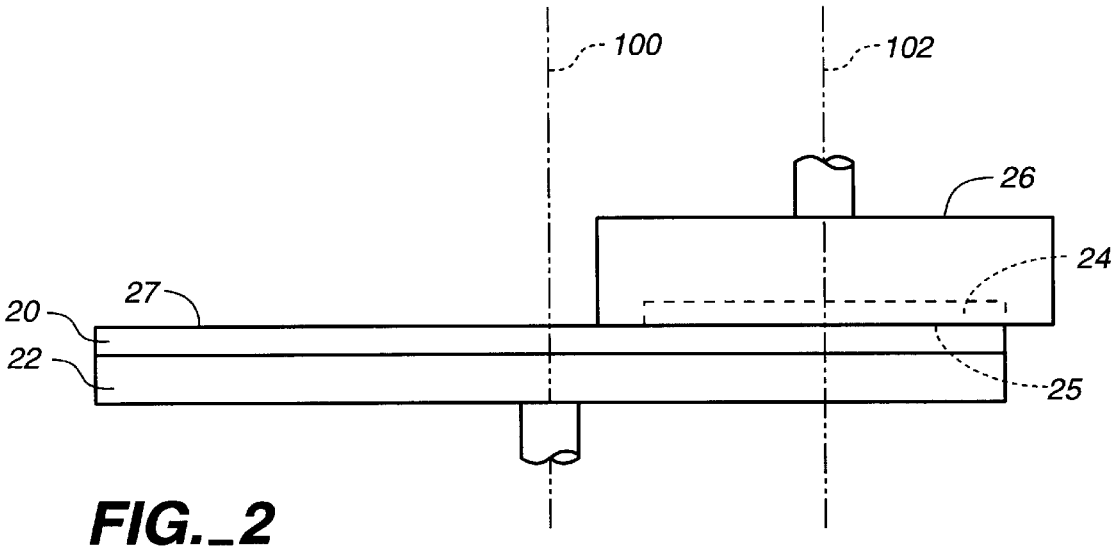
FIG. 2 is a schematic side view of the platen of FIG. 1.

As shown in FIGS. 1 and 2, a polishing pad 20 is secured atop a platen 22 (FIG. 2) and rotates about a central axis 100 in a counter-clockwise direction 110. A substrate, in the form of a circular semiconductor wafer 24, is held by a wafer carrier or polishing head (i.e., carrier head 26) so that a lower face 25 of the wafer is firmly placed in sliding engagement with an upper (polishing) surface 27 of the polishing pad. The polishing head 26 and wafer 24 substantially rotate as a unit about the polishing head's central axis 102 in a counter-clockwise direction 112. In addition to the rotation, the polishing head and wafer are simultaneously reciprocated between a first position (shown in solid lines in FIG. 1) and the a second position shown in phantom lines in FIG. 1. In an exemplary embodiment, the pad 20 has a diameter of about 20.0 inches, the wafer 24 has a diameter of about 7.87 inches (for a 200 millimeter wafer, commonly referred to as an "8 inch" wafer), the polishing head 26 has an external diameter of about 10 inches, and the carrier reciprocates so that the distance between the central axis 102 of the polishing head 26 and from the central axis 100 of the pad ranges between about 4.2 and 5.8 inches. The rotational speed of the pad may be about 150 rpm and that of the polishing head may also be about 150 rpm.

Figure 3:
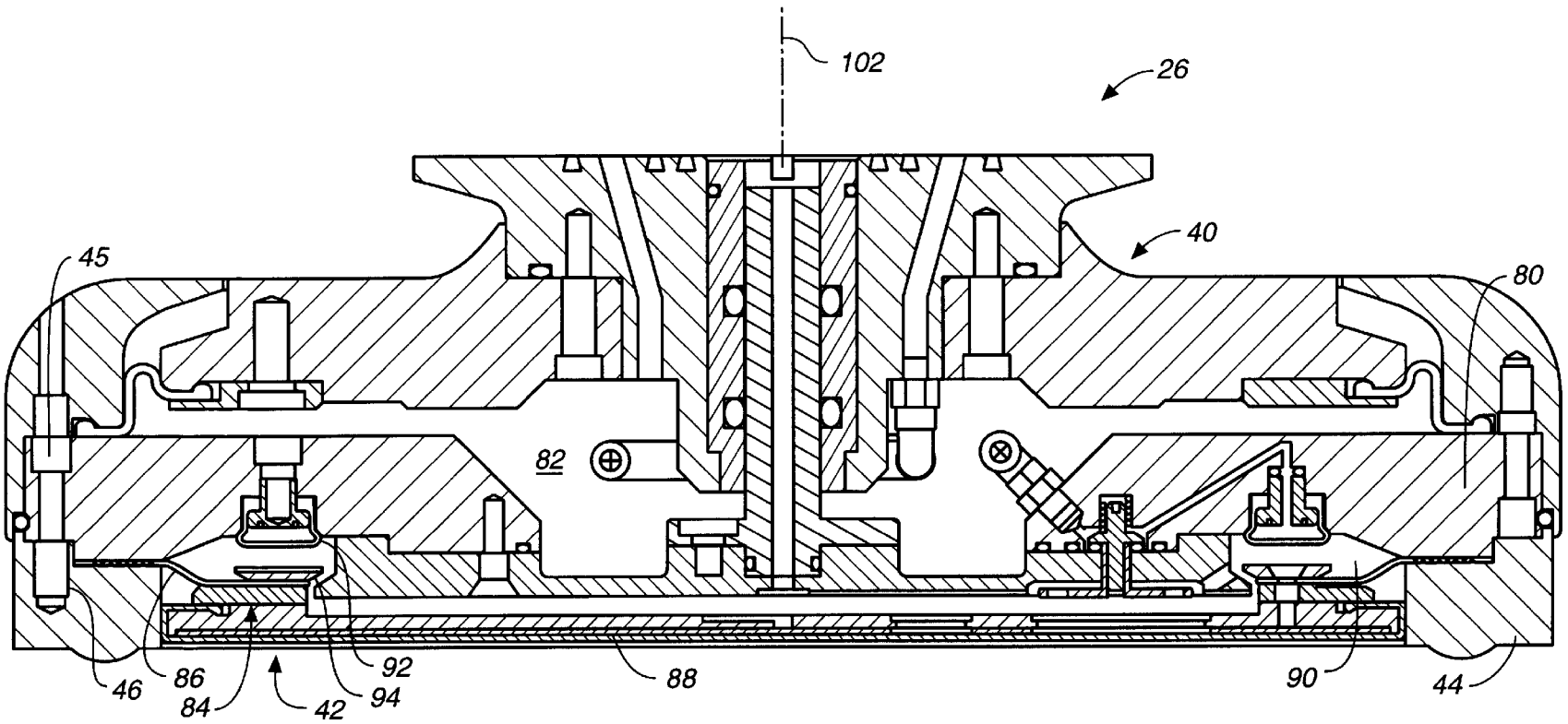
FIG. 3 is a cross-sectional view of a substrate polishing head having a retaining ring according to a first embodiment the present invention.

FIG. 3 shows further details of one exemplary construction of the polishing head 26. The polishing head 26 includes a housing 40 and a generally cylindrical substrate backing assembly 42 for holding the wafer 24. The backing assembly 42 can be moved up and down relative to the housing 40. The polishing head 26 further includes a generally annular retaining ring 44 for retaining the wafer 24 within the polishing head 26 during polishing. The retaining ring 44 may be attached to a base 80 by screws or bolts 45 which extend through the base 80 and into a plurality of mounting holes 46 in the retaining ring 44. The retaining ring 44 is movable vertically relative to the housing 40 independently of the backing assembly 42 so that desired downward forces may be applied to the retaining ring 44 and wafer 24 to maintain them in engagement with the polishing pad, as described in U.S. patent application Ser. No. 08/861,260, by Zuniga, et al., filed May 21, 1997, entitled A CARRIER HEAD WITH A FLEXIBLE MEMBRANE FOR A CHEMICAL MECHANICAL POLISHING SYSTEM, and assigned to the assignee of the present invention, the entire disclosure of which is hereby incorporated by reference.

A loading chamber 82 is formed between the housing 40 and base 80. Pressurization of the loading chamber 82 applies a load, i.e., a downward pressure and force, to the base 80. The vertical position of the base 80 relative to the polishing pad (not shown) may be controlled via pressurization/depressurization of the loading chamber 82.

The substrate backing assembly 42 includes a support structure 84, a flexure 86 connected between the support structure and the base 80, and a flexible membrane 88 connected to and covering the underside of the support structure 84. The flexible membrane 88 extends below the support structure to provide a mounting surface for the wafer. The pressurization of a chamber 90 formed between the base 80 and the substrate backing assembly presses the wafer against the polishing pad (FIG. 2).

An annular bladder 92 is attached to the lower surface of the base 80. The bladder may be pressurized to engage an annular clamp 94 atop an inboard (i.e., relatively close to the central axis 102) portion of the flexure 86 so as to apply a downward pressure to the support structure 84 and thus the wafer. The chamber 82 and bladder 92 may each be pressurized and depressurized via introduction and removal of fluid delivered from one or more pumps (not shown) by associated conduits or piping (also not shown).

Thus, the vertical position of the base 80 and ring 44 relative to the housing 40 may be controlled by pressurization and depressurization of the loading chamber 82. The pressurization of the loading chamber 82 pushes the base downward, which pushes the retaining ring 44 downward to apply a load to the polishing pad 20 (FIG. 2).

The vertical position of the substrate backing assembly 42 and thus the wafer may be controlled by pressurization and depressurization of the chamber 90 and/or the bladder 92. Depressurization of the chamber 90 raises the membrane so as to create suction between the membrane and wafer for lifting the wafer out of engagement with the polishing pad. Thus, the selective pressurization and depressurization of the loading chamber 82 on the one hand, and the bladder 92 and chamber 90 on the other hand provides for the independent maintenance of vertical position and engagement forces between the ring and pad and between the wafer and pad.

Figure 4:
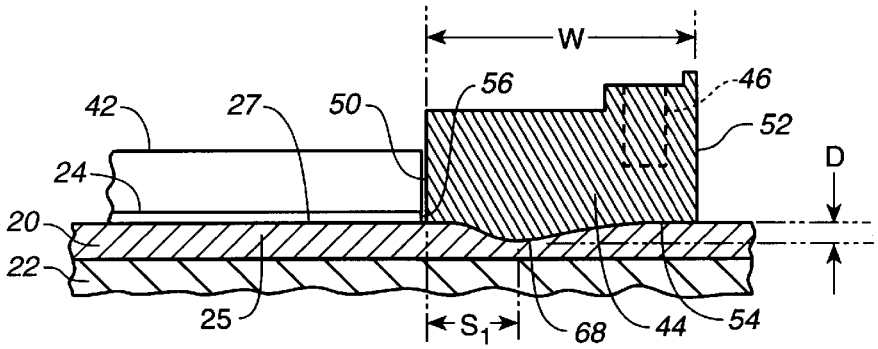
FIG. 4 is a closer schematic, cross-sectional view of the retaining ring of FIG. 3.

With reference to FIG. 4, the retaining ring has generally vertical cylindrical inboard and outboard faces 50 and 52, respectively, connected by a bottom face 54. The inboard face 50 serves as an inward facing retaining face for engaging and retaining the wafer against lateral movement as is described below. During polishing, the bottom face 54 contacts the upper surface 27 of the polishing pad 20 with sufficient force to compress the pad as is also described below with reference to FIG. 5.

During polishing, a net downward force is applied to the wafer 24 via the backing assembly 42 so as to slightly compress the polishing pad 20 beneath the wafer. The downward force, and thus the compression of the pad 20, are determined so as to achieve the desired polishing rate in view of such factors as the substrate material, pad material and thickness, rotational speeds, and presence/type of polishing slurry used.

Figure 5:
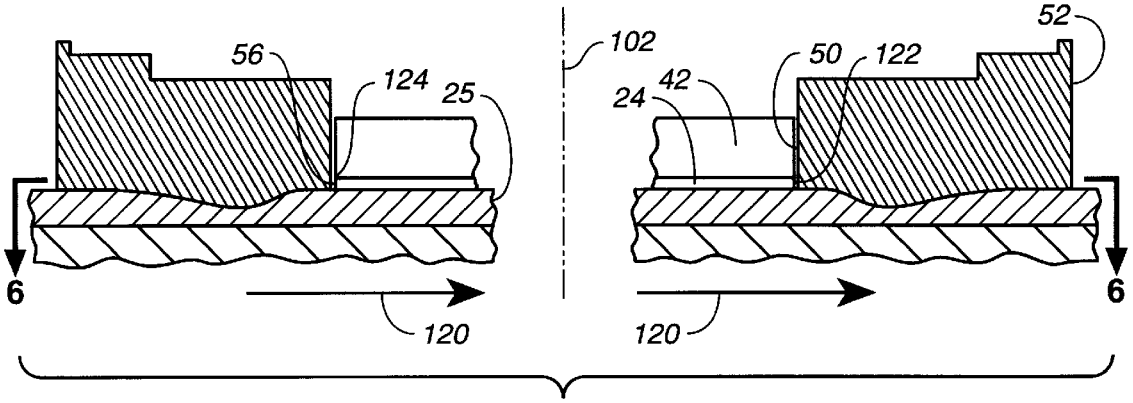
FIG. 5 is a partial cross-sectional schematic view of the retaining ring of FIG. 4, shown engaging and forcing a substrate against moving polishing pad.
Figure 6:
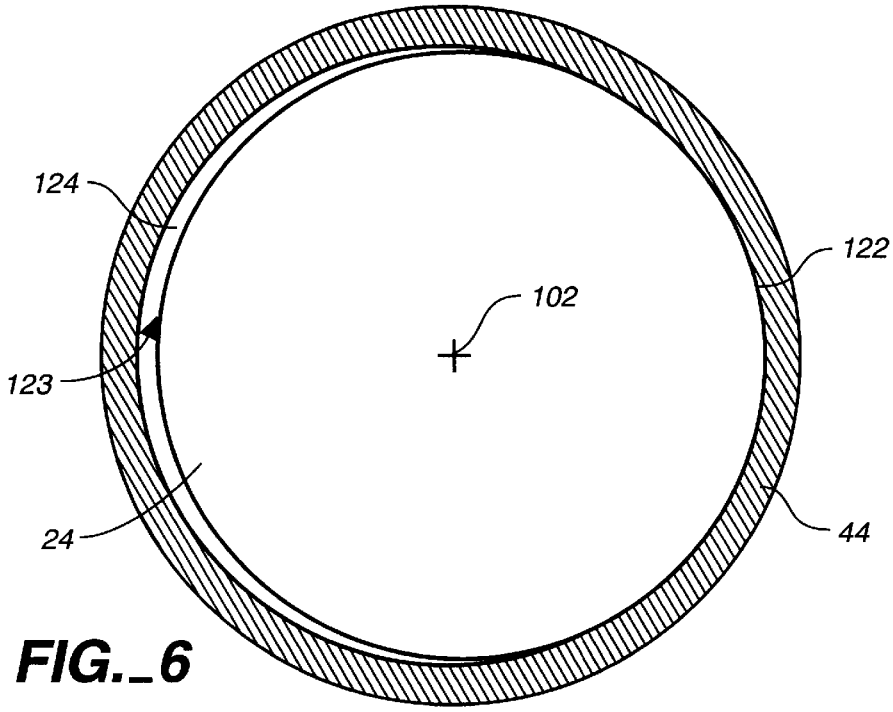
FIG. 6 is a schematic cross-sectional top view of the retaining ring and substrate of FIG. 5, taken along line 6—6.

As is further shown in FIG. 5, at any given moment, the polishing pad 20 may have a net general direction of motion 120 relative to the wafer 24 and polishing head 26, with friction between the pad 20 and wafer 24 applying a shear force to the wafer so as to bring the wafer edge or perimeter 56 into engagement with the retaining face 50 of the retaining ring 44. In the illustrated embodiment, the engagement is via direct contact at substantially a single location 122 along the wafer perimeter. As shown in FIG. 6, an increasing gap 123 between the perimeter 50 and retaining face 50 reaches a maximum at a location 124 at the "leading edge" of the wafer 24 diametrically opposite the location of contact 122. Even this maximum gap, however, is small, typically less than one millimeter.

Figure 7:
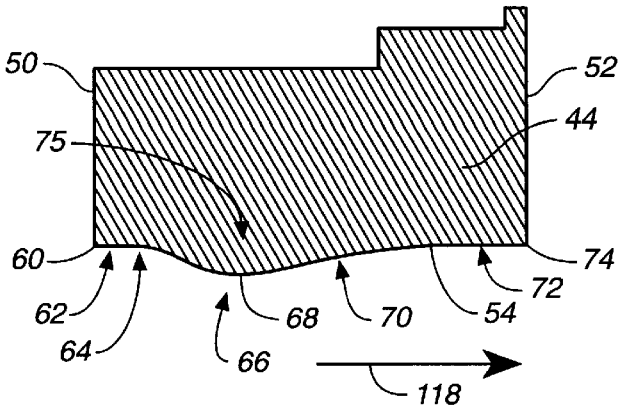
FIG. 7 is a partial, schematic and cross-sectional view of the retaining ring of FIG. 4.

As shown in FIG. 7, at the inboard edge of the bottom face 54 there is an intersection 60 with the retaining face 50. Proceeding outward from the intersection 60 the bottom face includes an annular downward facing flat horizontal region 62 which transitions to an annular downward facing concave region 64 descending from the horizontal region 62. The concave region 64 transitions to a convex region 66 which includes a lowermost region 68. In the outboard direction indicated by an arrow 118 in FIG. 7, the convex region 66 descends to the lowermost region 68 and ascends therefrom to join a second annular downward facing concave region 70 which transitions to a second annular flat horizontal region 72 which has an intersection 74 with the outer face 52 of the retaining ring. The concave and convex regions thus define an annular downward projecting lip 75 which, in operation, projects below the lower face of the substrate so as to provide enhanced pad compression outboard of the substrate perimeter.

In the illustrated embodiment of a polishing head 26 for polishing a 200 millimeter diameter wafer, the lowermost region 68 of the retaining ring is preferably at a distance S1 between approximately 5–15 millimeters outboard of the retaining face and more preferably approximately 10 millimeters outboard thereof. The lowermost region 68 preferably has a depth D of approximately 0.5–2.0 millimeters below the horizontal regions 62 and 72. Most preferably the lowermost region 68 has a depth D, approximately 1.0 millimeters below the horizontal regions 62 and 72. An exemplary width W between the retaining face 50 and the outboard face 52 is approximately 10–25 millimeters.

During polishing, with the pad compression beneath the wafer 24 having been determined by process considerations as described above, the force or pressure applied to the retaining ring 44 is chosen so as to substantially bring the flat horizontal regions 62 and 72 of the bottom face 54 of the ring into coplanar alignment with the bottom face 25 of the wafer 24 as shown in FIG. 5. However, in practice the actual force or pressure applied to the retaining ring 44 may be experimentally optimized to minimize observed edge effect.

In the illustrated embodiment, the retaining ring is formed of alumina or diamond-coated alumina. Other materials having relatively high wear resistance and low coefficients of friction with the polishing pad also may be used advantageously.

This general configuration of the retaining ring is believed to reduce the edge effect. In particular, especially near the leading edge (i.e., adjacent location 124 in FIG. 5), the additional compression provided by the downward projecting lip 75 is believed to reduce edge effect associated with relaxation of the pad in the gap 123 between the substrate and the retaining face. Other embodiments described below may have similar effects.

Figure 8:
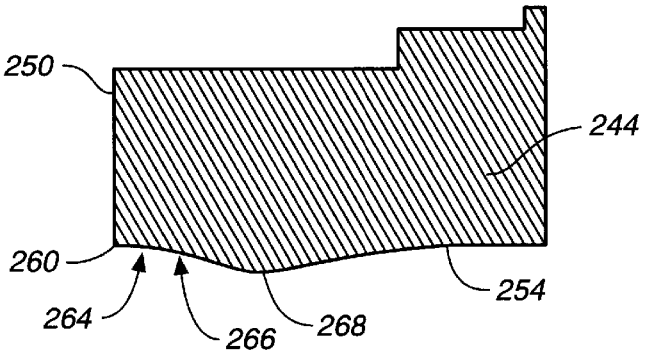
FIGS. 8, 9 and 10 are partial, schematic and cross-sectional views of alternate embodiments of retaining rings according to the present invention.

FIG. 8 shows a retaining ring 244 configured in accordance with a second embodiment. The bottom face 254 of the retaining ring has no flat horizontal inboard region. Rather, an annular downward facing concave region 264 descends directly from the intersection 260 of the bottom face with the retaining face 250. The concave region 264 transitions to a convex region 266 which includes a lowermost portion 268.

Figure 9:
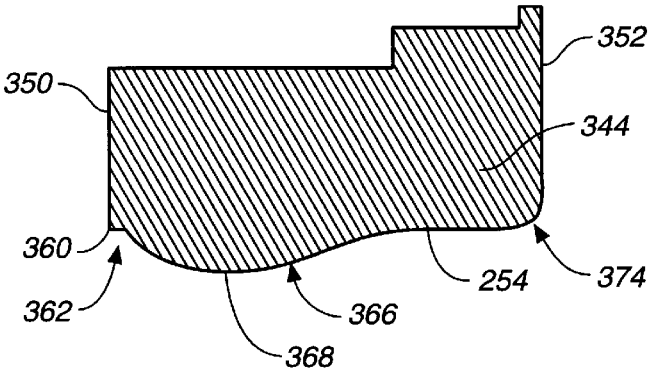

FIG. 9 shows a retaining ring 344 configured in accordance with a third embodiment. In this third embodiment, there is no inner concave region. The downward facing flat horizontal region 362 has an intersection 360 with the retaining face 350. The horizontal region 362 transitions directly to an annular downward facing convex region 366 which includes a lowermost portion 368. Further, there is a rounded transition region 374 between the bottom face 354 and outboard face 352.

Figure 10:
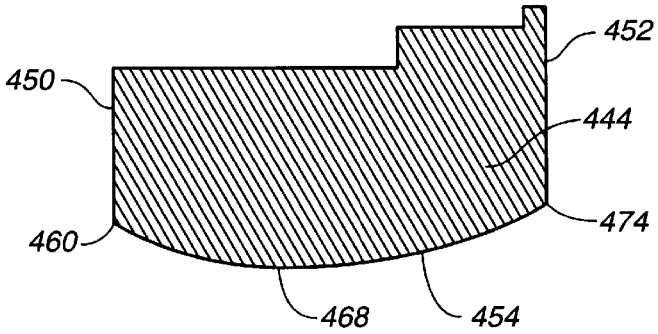

FIG. 10 shows a retaining ring 444 configured in accordance with a fourth embodiment. The ring 444 features a bottom face 454 formed as a single downward facing convex region 468 having intersections 460 and 474 with vertical inboard and outboard cylindrical faces 450 and 452, respectively. The inboard intersection 460 is at a lower height (i.e., closer to the platen 22 (FIG. 2) than the outboard intersection 474. Such relative intersection heights may be established so that the polishing pad is largely uncompressed adjacent the outboard intersection 474 or so that the bottom face 454 may disengage the pad slightly inboard of the intersection 474.

A number of embodiments of the present invention have been described. Nevertheless, it will be understood that various modifications may be made without departing from the spirit and scope of the invention. For example, required adaptations for particular carrier constructions will significantly influence the ring configuration. A balancing of factors including the acceptable level of ring wear, the type of pad and polishing slurry, the type of substrate, and the polishing rate all will influence ring design. Accordingly, other embodiments are within the scope of the following claims.

What is claimed is:

1. A retaining ring for use in conjunction with an apparatus having a polishing surface to contact and polish a substrate, the retaining ring comprising:

a retaining face that retains the substrate against lateral movement; and a substantially nonplanar bottom face which has a first region adjacent the retaining face and a second region surrounding the first region, both regions contacting the polishing surface during polishing of the substrate, the second region compressing the polishing surface to a greater degree than the first region.

2. The retaining ring of claim 1, wherein the second region includes a lowermost portion positioned below a lower face of the substrate during polishing.

3. The retaining ring of claim 1, wherein the second region includes a lowermost portion which is approximately 5 to 15 millimeters outboard of the retaining face.

4. The retaining ring of claim 3, wherein the lowermost portion is approximately 10 millimeters outboard of the retaining face.

5. The retaining ring of claim 1, wherein a lowermost portion of the bottom face is located approximately 0.5 to 2.0 millimeters below the retaining face during polishing.

6. The retaining ring of claim 5, wherein the lowermost portion is approximately 1 millimeter below the retaining face.

7. A retaining ring for use in conjunction with an apparatus for polishing a substrate, the substrate having upper and lower faces and a lateral perimeter, the apparatus having a polishing pad with an upper polishing surface for contacting and polishing the lower face of the substrate, the retaining ring comprising:

an inner face for surrounding and engaging the substrate perimeter; and a bottom face extending outward from the inner face for contacting the polishing surface of the polishing pad, the bottom face of the ring having an annular downward facing convex region.

8. The retaining ring of claim 7, wherein the bottom face of the retaining ring has an annular downward facing concave region inboard of the annular downward facing convex region.

9. The retaining ring of claim 8, wherein the bottom face of the retaining ring has a second annular downward facing concave region outboard of the annular downward facing convex region.

10. The retaining ring of claim 8, wherein the bottom face of the retaining ring has an annular downward facing flat horizontal region inboard of the annular downward facing convex region.

11. The retaining ring of claim 8, wherein the retaining face is substantially vertical and wherein the retaining ring further comprises a vertical outboard face, the bottom face of the retaining ring connecting the retaining face and the outboard face and having a first annular intersection with the retaining face and a second annular intersection with the outboard face, the first annular intersection located at a lower height than the second annular intersection.

12. A retaining ring for use in conjunction with an apparatus for chemical mechanical polishing a substrate, the substrate having upper and lower faces and a perimeter, and the apparatus having a moveable polishing pad to contact and polish the lower face of the substrate, the retaining ring comprising:

an inward facing retaining face to engage and retain the substrate against lateral movement and a bottom face to contact the polishing surface of the polishing pad, the bottom face having a downward projecting lip, which lip projects below the lower face of the substrate and the inward facing retaining face.

13. An apparatus to polish a substrate, comprising:

a platen rotatable about a central axis;

a polishing pad carried by the platen and having a polishing surface to contact and polish the substrate; and a polishing head configured to hold the substrate in engagement with the polishing pad and rotatable about a head axis, the polishing head including a retaining ring having an inward facing retaining face configured to retain the substrate against lateral movement and a substantially nonplanar bottom face which has a first region and a second region surrounding the first region, both regions contacting the polishing surface during polishing of the substrate, wherein the second region compresses the polishing surface more than the first region.

14. A polishing head to hold a substrate in engagement with a polishing pad, the head comprising:

a housing;

a substrate backing member to engage an upper surface of the substrate, the substrate backing member vertically movable relative to the housing to maintain a lower surface of the substrate in engagement with the polishing pad; and a retaining ring vertically movable relative to the substrate backing member and having an inward facing retaining face to retain the substrate against lateral movement and a substantially nonplanar bottom face which has a first region and a second region surrounding the first region, both regions contacting the polishing surface during polishing of the substrate, wherein the second region compresses the polishing pad more than the first region.

15. A retaining ring for use in conjunction with an apparatus for polishing a substrate, the apparatus having a polishing surface to polish the substrate, the retaining ring comprising:

a generally annular inward facing retaining face configured to retain the substrate against lateral movement during polishing; and a bottom face configured to depress the polishing surface during polishing, wherein the bottom face has a first annular region which extends below the retaining face during polishing a first distance to contact the polishing pad and a second annular region which encircles the first annular region and extends below the retaining face during polishing a second distance which is greater than the first distance.

16. A method for polishing a substrate having a perimeter, the method comprising:

rotating a compressible polishing pad having a polishing surface;

placing the substrate in contact with the polishing surface; and compressing the polishing pad with a substantially nonplanar bottom face of a retaining ring to a first amount at a first location outboard of the perimeter of the substrate and to a second amount that is greater than the first amount at a second location outboard of the first location, so as to apply a pressure distribution to the polishing pad in a region extending between the first location and the second location.

17. A retaining ring for use with an apparatus having a compressible polishing pad, the retaining ring comprising:

a retaining face that retains the substrate against lateral movement; and a substantially nonplanar bottom face to contact the polishing pad during polishing, the bottom face including a substantially planar region adjacent the retaining face to contact the polishing pad, and a projection extending from the substantially planar region to contact the polishing pad and compress the polishing pad a greater amount than the planar region.

* * * * *